US008601930B2

(12) United States Patent
Roberson

(10) Patent No.: US 8,601,930 B2
(45) Date of Patent: Dec. 10, 2013

(54) ARMOUR

(75) Inventor: Colin Roberson, Rugby Warwickshire (GB)

(73) Assignee: Advanced Defence Materials Limited, Rugby Warwickshire (GB)

( * ) Notice: Subject to any disclaimer, the term of this patent is extended or adjusted under 35 U.S.C. 154(b) by 137 days.

(21) Appl. No.: 13/202,407

(22) PCT Filed: Feb. 19, 2010

(86) PCT No.: PCT/EP2010/052133
§ 371 (c)(1),
(2), (4) Date: Nov. 14, 2011

(87) PCT Pub. No.: WO2010/094768
PCT Pub. Date: Aug. 26, 2010

(65) Prior Publication Data

US 2012/0055325 A1 Mar. 8, 2012

(30) Foreign Application Priority Data

Feb. 20, 2009 (GB) ..... 0902803.6

(51) Int. Cl.
*F41H 1/02* (2006.01)

(52) U.S. Cl.
USPC ..... 89/36.05; 89/36.02; 89/917; 89/906; 89/922; 2/2.5

(58) Field of Classification Search
USPC ..... 89/36.02, 36.05, 917, 906, 922; 2/2.5
See application file for complete search history.

(56) References Cited

U.S. PATENT DOCUMENTS

2007/0137471 A1 * 6/2007 Mazur ..... 89/36.02

FOREIGN PATENT DOCUMENTS

| | | | | |
|---|---|---|---|---|
| GB | 2 285 209 A | | 7/1995 | |
| GB | 2 287 639 A | | 9/1995 | |
| WO | 92/00497 A1 | | 1/1992 | |
| WO | WO 92/00497 | * | 1/1992 | ..... 89/36.02 |
| WO | 92/16813 A1 | | 10/1992 | |
| WO | 92/20520 A1 | | 11/1992 | |
| WO | 01/32404 A2 | | 5/2001 | |

OTHER PUBLICATIONS

International Search Report from PCT/EP2010/052133 datd Nov. 5, 2010 (5 pages).

* cited by examiner

*Primary Examiner* — Stephen M Johnson
(74) *Attorney, Agent, or Firm* — Osha Liang LLP

(57) ABSTRACT

A bullet-resistant armor element for use as a tessellation in a flexible armor matrix has a hard main body and a facing over said main body, such as layer of polymeric or polymer matrix composite material, wherein the facing has an acoustic impedance which is substantially lower than the acoustic impedance of the main body. Groups of said elements tessellate to form an aperture between the adjacent elements, and a cover element is arranged to cover said aperture. Limit stops restrict the degree of articulation between the adjacent elements. The elements include a deflector for deflecting bullet splash and traps for collecting bullet splash.

19 Claims, 3 Drawing Sheets

ARMOUR

The present invention relates to armor, more particularly, but not exclusively, to armor that is intended to be worn by a user, for example flexible armor systems and bullet-resistant armor.

Flexible body armor has been in existence for many hundreds of years. One known form of flexible body armor is similar to the protective coat of an armadillo, wherein rows of overlapping armor plates are arranged in such a way that relative movement between adjacent rows is possible, without exposing a significant gap between the rows.

Typically, conventional systems require a significant degree of overlap between the adjacent rows. This, of course, increases the weight of the armor. In modem times, the weight and or bulk of the material required to provide reliable armor performance against armor-piercing bullets and the like makes the use of such overlapping systems impractical for personal armor systems requiring effective bullet resistance.

An object of the invention is to provide armor elements which are more suited to modern day combat requirements, in terms of flexibility and/or bullet resistance.

According to a first aspect of the invention, there is provided an armor element for use as a tessellation in a flexible armor matrix.

The armor element is preferably polygonal in plan view, more preferably in the form of an octagon. The polygonal element is preferably configured so that, in tessellation with other elements of the same kind and configuration, an aperture is formed between said elements.

The armor element preferably comprises a hard element, more preferably a hard element suitable to provide bullet-resistance. That is to say, the armor element is preferably configured for use in bullet-resistant armor systems, as opposed to armor systems configured for resisting knife-attack, for example. The skilled person will therefore be able to construe the term 'hard element' accordingly.

The skilled person would be readily able to identify materials exhibiting hardness and/or acoustic impedance properties suitable for use in bullet-resistant armor systems, and so such materials or methods for configuring such materials to promote such properties are not described herein in detail. Hardness and acoustic impedance are intrinsic properties of certain materials and those with knowledge will be able to develop and/or select from existing commercial materials those which are suitable for application in a bullet-resistant armor system.

In preferred embodiments, the hard element is made of a ceramic material, and may be a ceramic-ceramic composite or ceramic-metal composite.

In preferred embodiments, the hard element has a hardness and/or acoustic impedance suitable to efficiently defeat modern day armor piercing bullets such as tungsten carbide or steel cored bullets, e.g. configured with a hardness of at least 15 GPa ($Hv_{0.5}$ 1500 Kg $mm^{-2}$) and/or with an acoustic impedance of at least 35 MRayl. This may involve a ceramic or ceramic composite, and examples of materials suitable for use in providing a hard element with such hardness and/or acoustic impedance properties include aluminium oxide, silicon carbide and boron carbide.

In other embodiments, the armor may be specifically configured for dealing with lead or mild steel cored ball round and/or fragmentation from explosive ordnance devices (i.e. so as to be generally unsuitable for defeating tungsten carbide or steel cored bullets), in which case the hard element may be configured with a hardness in the region of 3 GPa and/or with an acoustic impedance in the range of 10 MRayl. The materials for use in providing such hardness and/or acoustic impedance properties include silicates, porcelain glasses, glass ceramics, metal or combinations thereof.

Other materials (e.g. metals, ceramics and metal matrix composites) may be applicable for achieving specific hardness/acoustic impedance values for other specific armor applications.

The acoustic impedance of the hard element is preferably suitable to produce a shock wave in a bullet core sufficient to fragment the bullet, upon impact with the armor element. The effect is to disperse kinetic energy from the bullet, thereby reducing the penetrative capability of the bullet.

The armor element preferably includes a facing over the hard element, such as layer of polymeric or polymer matrix composite material. The facing may be a single component specific to a single armor element, or may take the form of a continuous component configured to extend across an array of two or more armor elements. In the latter instance, the facing is preferably of elastomeric material, suitable to permit relative movement between the armor elements in the array.

The facing is preferably configured for promoting dynamic pre-compression of the upper surface of the hard element, suitable to cause a temporary increase in hardness of the material, upon impact from a bullet. This may be suitable to partially defeat armor piercing bullets impacting with the face of the armor element, an effect commonly referred to as 'interface defeat'. This delays or restricts penetration to the hard element and increases the performance of the armor element.

To provide the above effect, the facing preferably has an acoustic impedance which is substantially lower than the acoustic impedance of the hard element, e.g. less than 25% of the acoustic impedance of the hard element. The purpose of the facing is to acoustically decouple the effect of the impact from the bullet, to reduce the effect of shock waves generated by the impact from passing through the hard element and causing premature failure of the armor element. In the case of ceramic and ceramic composite materials, the crystal lattice of the hard element exhibits little or no plastic behaviour and so the pressure of the impact will cause the lattice structure to deform, generating a localised hardening of lattice structure. However, in the absence of an acoustic decoupling facing, the impact may simultaneously generate shockwaves capable of fracturing the lattice structure, which, in addition to the pressure from the impact, may cause premature failure of the armor element.

The hard element preferably comprises the main body of the armor element, and is preferably mounted on a base forming a back plate for the armor element. The base is preferably in the form of a layer of metal material, e.g. titanium, steel or aluminium. In other embodiments, the base is a fibre reinforced composite (e.g. using glass or carbon fibre), or is made of rubber or plastic.

The base is preferably cupped or otherwise configured to provide a lateral constraint for the sides of the hard element.

According to a further aspect of the invention, there is provided a bullet resistant armor element, comprising a main body mounted on a base, wherein the main body has a hardness and/or acoustic impedance suitable to efficiently defeat modem day armor piercing bullets such as tungsten carbide or steel cored bullets, e.g. configured with a hardness of at least 15 GPa ($Hv_{0.5}$ 1500 Kg $mm^{-2}$) and/or with an acoustic impedance of at least 35 MRayl.

This may involve a ceramic or ceramic composite, and examples of materials suitable for use in providing a main body with such hardness and/or acoustic impedance properties include aluminium oxide, silicon carbide and boron carbide.

The acoustic impedance of the main body is preferably suitable to produce a shock wave in a bullet core sufficient to fragment the bullet, upon impact with the armor element. The effect is to disperse kinetic energy from the bullet, thereby reducing the penetrative capability of the bullet.

The armor element preferably includes a facing over the main body, such as layer of polymeric or polymer matrix composite material. The facing may be a single component specific to a single armor element, or may take the form of a continuous component configured to extend across an array of two or more armor elements. In the latter instance, the facing is preferably of elastomeric material, suitable to permit relative movement between the armor elements in the array.

The facing is preferably configured for promoting dynamic pre-compression of the upper surface of the main body of the armor element, to delay or restrict penetration to the main body and increase the performance of the armor element. This is discussed in more detail with reference to the above aspect of the invention. Accordingly, the facing preferably has an acoustic impedance which is substantially lower than the acoustic impedance of the main body, e.g. less than the of 25% of the acoustic impedance of the main body.

The main body is preferably mounted on a base forming a back plate for the armor element. The base is preferably in the form of a layer of metal material, e.g. titanium, steel or aluminium. In other embodiments, the base is a fibre reinforced composite (e.g. using glass or carbon fibre), or is made of rubber or plastic.

The base is preferably cupped or otherwise configured to provide a lateral constraint for the sides of the main body.

The armor element is preferably polygonal in plan view, more preferably in the form of an octagon. The polygonal element is preferably configured so that, in tessellation with other elements of the same kind and configuration, an aperture is formed between said elements.

The main body is preferably of ceramic material. In preferred embodiments, the main body may be of ceramic-ceramic composite or ceramic-metal composite.

In addition, the armor element may incorporate one or more of the preferred or essential features of the armor elements referred to in any of the other aspects of the invention mentioned herein.

According to another aspect of the invention, there is provided a flexible armor system comprising an array of armor elements in tessellation to form an aperture therebetween, and a cover element arranged to cover the aperture between the elements.

The armor system preferably includes a backing layer suitable for collecting sporation or debris behind the array of armor elements. This renders the armor system suitable for use as a stand alone body armor, which obviates the need for a ballistic vest. The backing layer may comprise an array of overlapping elements, each coupled to a respective cover element, e.g. via a shaft passing through the array of armor elements, in which the backing elements preferably comprise a hard fibrous composite armor material.

Armor elements in the array may be of the kind referred to in any of the other aspects of the invention mentioned herein.

According to yet another aspect of the invention, there is provided an armor element having a hard main body and a facing for the main body, wherein the facing has an acoustic impedance which is substantially lower than the acoustic impedance of the main body, e.g. less than the of 25% of the acoustic impedance of the main body.

In addition, the armor element may incorporate one or more of the preferred or essential features of the armor elements referred to in any of the other aspects of the invention mentioned herein.

According to another aspect of the invention, there is provided an armor element having a hard main body and an acoustic decoupling facing. The facing is preferably configured a) to permit pre-compression of the main body upon impact from a bullet and b) to reduce the transmission of shock waves to the main body as a result of the impact.

This is particularly useful in defeating the effects of armor piercing bullets, by enabling the main body to pre-compress and strengthen upon impact, an effect known as 'interface defeat', thus delaying or restricting the penetration to the main body and increasing armor performance, as well as by reducing the magnitude of potentially destructive shock waves travelling through the main body as a result of the impact.

In addition, the armor element may incorporate one or more of the preferred or essential features of the armor elements referred to in any of the other aspects of the invention mentioned herein.

According to still a further aspect of the invention, there is provided an armor element having a hard main body mounted on a base, wherein the main body is located on the base in such a way as to protect the main body against shock waves from the interface between the main body and the base member.

The main body is preferably joined to the base using an adhesive having rubber properties or may be partially acoustically coupled to the base using an adhesive or cement incorporating a compound of polymer loaded with a high impedance material, such as a ceramic or dense metal powder. In other embodiments, the base may be of metal and the main body can be brazed or diffusion bonded thereto. The main body may have a rear face of porous nature, whereby the base metal may be partially infused to the main body to make an interpenetrating metal ceramic composite structure.

In addition, the armor element may incorporate one or more of the preferred or essential features of the armor elements referred to in any of the other aspects of the invention mentioned herein.

According to a yet further aspect of the invention, there is provided a flexible armor system including a group of armor elements arranged in a tessellated array, wherein each element in the array is movable relative to an adjacent element in the array, and wherein the array defines an aperture between the group of elements, the amour system further including a cover element arranged to cover the aperture in the array, wherein the cover element is movable relative to each element in the array.

The cover element preferably has a stem which extends through the aperture between the tessellated armor elements. A back stop is preferably connected to the stem to limit movement of the cover element relative to the array. The back stop preferably includes a backing element, the backing elements in the system being configured to overlap with one another so as to form a backing layer suitable for collecting sporation or debris behind the array of armor elements. The backing elements preferably comprise a hard fibrous composite armor material.

The cover element is preferably configured to cover a proportion of the joint between adjacent pairs of the tessellated elements when the upper surfaces of the elements are in register with one another. In a preferred embodiment, the cover element is configured to cover approximately 50 percent of each joint.

The armor system may include a plurality of said groups, each group having its own cover element.

The or each cover element preferably has a cap which rests in abutment with the upper surfaces of the elements in the array. The cap is preferably dome-shaped, for deflecting armor piercing bullets.

A nested joint is preferably provided between adjacent elements in the or each array. The nested joint is preferably configured to permit articulation between adjacent elements in the array. Preferred embodiments include limit stops between adjacent elements in the array, to restrict the degree of articulation between the adjacent elements.

The nested joint is preferably defined by a convex formation on one element and a complementary concave formation on the other element.

In a preferred embodiment, adjacent elements in the or each array are arranged for articulation relative to one another, and wherein the degree of articulation between the adjacent elements is restricted to prevent or limit the risk of significant gaps from being generated between the adjacent elements. A rolling joint is preferably provided between the adjacent elements in the array, consisting of a concave side on one of the elements which is nested with a convex side on the other of said elements, and wherein the concave side incorporates an ear having a recess, and the convex side has a rib or projection configured to be received in the recess of an adjacent element, wherein the recess acts as a limit stop for the projection, so as to limit the degree of rolling at each joint.

The ear preferably acts as a deflector for deflecting bullet splash. The recess preferably acts as a trap for collecting bullet splash.

In preferred embodiments, the ear is configured to extend beneath an adjacent element in the array. The ear preferably has a curvature which is complementary to a preferred arc of articulation between the adjacent elements.

At least one of said elements (more preferably each element) in the or each array has a main body with a hardness of at least 7.5 GPa ($Hv_{0.5}$ 750 Kg $mm^{-2}$), more preferably a hardness of at least 15 GPa ($Hv_{0.5}$ 1500 Kg $mm^{-2}$).

At least one of said elements (more preferably each element) in the or each array has a main body with an acoustic impedance of at least 25 MRayl, more preferably an acoustic impedance of at least 35 MRayl.

In preferred embodiments, at least one of said elements (more preferably each element) in the or each array includes a main body and a facing over said main body, such as layer of polymeric or polymer matrix composite material, wherein the facing has an acoustic impedance which is substantially lower than the acoustic impedance of the main body, for providing bullet-resistance. The facing preferably has an acoustic impedance which is less than the of 25% of the acoustic impedance of the main body.

The main body preferably has an acoustic decoupling facing configured to permit pre-compression of the main body upon impact from a bullet.

The main body preferably has an acoustic decoupling facing configured to reduce the transmission of shock waves to the main body as a result of impact from a bullet.

In preferred embodiments, the armor element includes a hard main body mounted on a base, for example a layer of metal material. The base is preferably configured to provide lateral constraint for side regions of the hard main body.

The amour elements preferably include a main body of ceramic or ceramic-ceramic composite or ceramic-metal composite material. The armor elements are preferably of the same kind and configuration, and may be polygonal in plan view (e.g. octagonal).

There is also provided personnel armor to be worn by a user incorporating a flexible armor system in accordance with the above aspect of the invention.

Aspects of the invention are particularly, but not exclusively, applicable to body armor, i.e. armor intended to be worn by a human or animal, or armor which is intended to cover movable plant or machinery, such as gun turrets on military vehicles and craft.

Other aspects and features of the invention will be readily apparent from the claims and the following description, which is made by way of example only, with reference to the accompanying drawings, in which:

Figure 1:
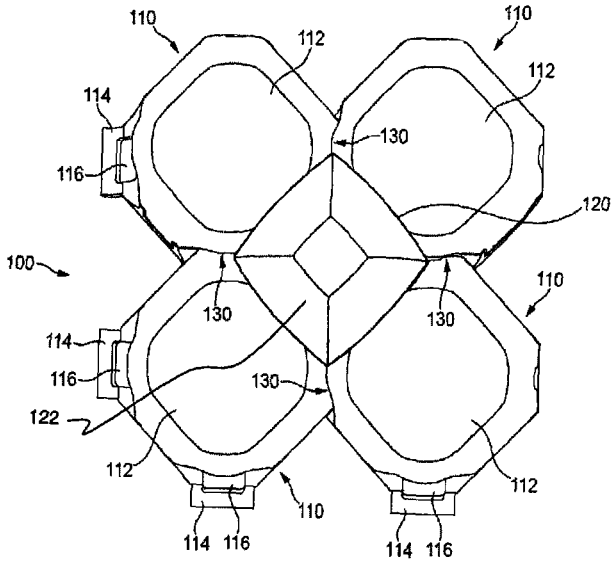
FIG. 1 is a schematic plan view of a section of body armor.
Figure 2:
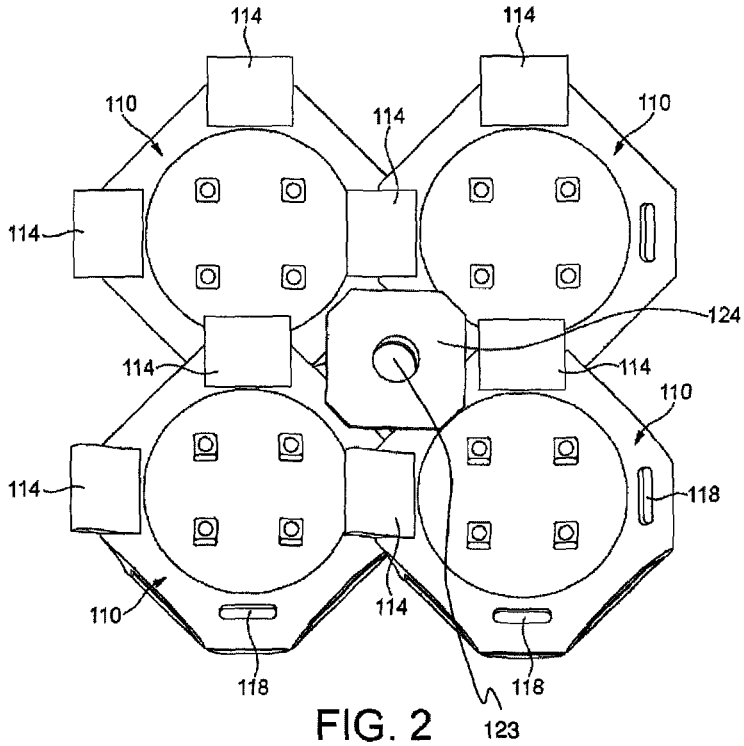
FIG. 2 is schematic view from underneath the body armor section of FIG. 1.
Figure 3:
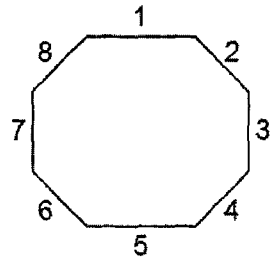
FIG. 3 shows an octagon with its sides numbered from one to eight.

Referring firstly to FIGS. 1 and 2, an array of armor elements for use in a flexible armor system is indicated generally at 100.

The array 100 has a first layer consisting of generally octagonal elements 110, which tessellate to form a central aperture (not shown). The octagonal elements 110 are of identical shape and configuration and define a generally planar upper surface 112.

A generally square cover element 120 is provided over the central aperture. The cover element 120 is configured to cover a significant proportion of the joint 130 between adjacent pairs of the tessellated elements 110 when the upper surfaces 112 of the elements 110 in the first layer are in register with one another. In the illustrated embodiment, it can be seen that the cover element is configured to cover approximately 50 percent of each joint 130.

The joint 130 between adjacent pairs of said elements 110 is configured to enable articulation between the adjacent elements 110. In this embodiment, each joint consists of a nested arrangement, wherein a convex formation on one side of the joint 130 is received in a complementary concave formation on the other side of the joint 130. Taking the octagon in FIG. 2 as an illustrative example (in which the sides of the octagon are numbered 1 to 8), the corresponding sides 1 and 7 on each element 110 are concave and the diametrically opposite sides 3 and 5 on each element 110 are convex. This nested arrangement enables rolling between adjacent pairs of said elements 110 in the array 100.

The degree of articulation between adjacent elements 110 is purposefully restricted to prevent or limit the risk of significant gaps from being generated between adjacent elements 110 in the array 100. In this embodiment, the concave sides of each element 110 incorporate an ear 114 having a recess 116, and the convex sides of the element 110 have a rib or projection 118 (see FIG. 2) configured to be received in the recess 116 of an adjacent element 110. The recess 116 acts as a limit stop for the projection 118, so as to limit the degree of rolling at each joint 130.

Each ear 114 is configured to extend beneath an adjacent element in the array and has a curvature which is complementary to the articulation of the adjacent elements.

It is known that bullets containing lead or other filler material may partially vaporise and melt upon striking armor. The resultant material may seep in to or penetrate weak points in the armor, which may injure the wearer of the armor. This phenomenon is known as bullet splash. However, the elements 110 incorporate deflectors and traps for reducing the deleterious effects of bullet splash. In this embodiment, the ears 114 are arranged such that molten material, upon contact with an ear 114, is deflected from its path through at least 45 degrees and more preferably through 90 degrees, so as to greatly reduce or eliminate the penetrative force of the molten material. Furthermore, the recesses 116 act as a trap for collecting such molten material.

It is preferred if the inter-engaging surfaces between adjacent elements, e.g. the curved and convex formations, are mirror-finished and/or are coated with a low friction material. The coating may include a lower layer which is hard undercoat, a priming layer over said lower layer and a top layer adhered to the priming layer. Preferably, at least the top layer has a very low coefficient of friction and is very hard.

The cover element 120 has a cap 122 and a stem 123 depending from the cap 122, wherein the cap is of greater diameter than the stem 123 (and is therefore generally mushroom-shaped). In use, the cap 122 is intended to sit over the central aperture between the elements 110. The cap 122 rests in abutment with the upper surfaces 112 of the elements 110, when the stem 123 is received in the central aperture. The cap 122 is preferably dome-shaped, for deflecting armor piercing bullets.

The cover element 120 is preferably arranged so as to be free-floating in the array 100, and thereby able to move in response to movement of one or more of the elements 110 in the array 100. For example, as the array 100 is flexed in use, the cover element 120 is able to rock on the underlying elements 110, with the stem 123 moving inwards or outwards with respect to the central aperture, depending on the direction of flex of the array 100.

A plate or back stop 124 is preferably connected to the stem 123 of the cover element 120. The back stop 124 provides additional cover for the central aperture between the elements 110 and also acts as a splash trap. Moreover, it provides support for the back face of array 100.

The stem 123 of the cover element 120 acts as a spacer between the cap 122 and back stop 124, and is configured to ensure that the cap 122 stays close to or in abutment with the octagon elements 110 when the array 100 is flexed.

An additional backing layer may be provided behind the array 100, e.g. for collecting spall or sporation from the armor elements 110.

Whereas, typically, the array 100 may be worn as armor over a ballistic vest, the use of a sporation collecting layer behind the array 100 renders such undergarments unnecessary. In one embodiment, the backing layer consists of an array of overlapping elements provided on the back stops 124. These elements will preferably have a much greater surface area than the back stops 124, in order to overlap with one another and thereby provide a substantially continuous layer behind the array 100. These elements may be adhered or otherwise affixed on the back stops 124, and preferably comprise a hard fibrous composite armor material.

The elements 110 in the array 100 are preferably coupled together using a tape or other material in such a way as to pre-tension the array 100. The material preferably has predetermined stretch and overstretch limits and may be applied to front and/or back faces of the array 100. The pre-tensioning material may be mechanically affixed and/or bonded to the elements 110 in the array 100.

The armor elements 110 may take various forms and may have a solid or composite structure. Each element 110 consists of a main body of hard material, and in the most preferred embodiments, the elements 110 have a hardness in the region of 15 GPa ($Hv_{0.5}$ 1500 Kg $mm^{-2}$) and an acoustic impedance in the region of 35 MRayl.

Figure 4:
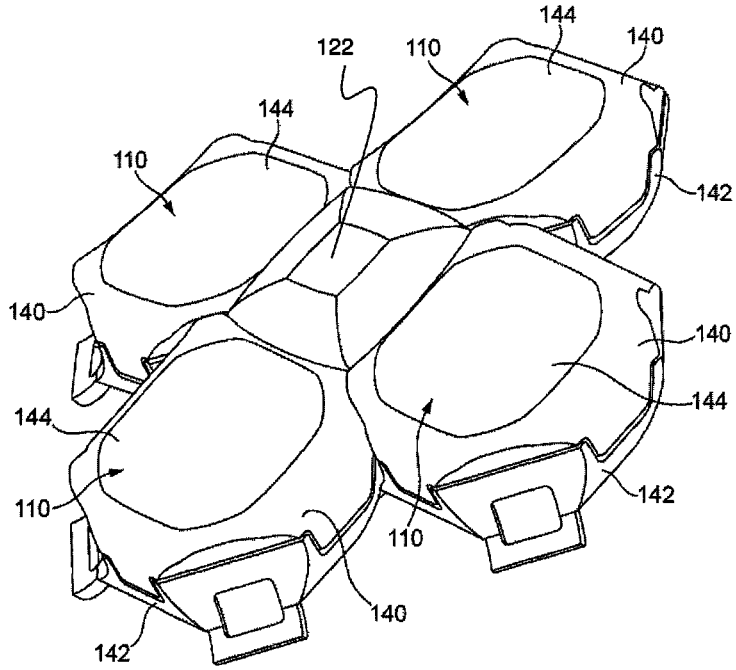
FIG. 4 shows a modified version of the array in FIGS. 1 and 2, consisting of composite armor elements.

The main body is preferably is mounted on a base member. More preferably, the main body is at least partially contained on a base member. Such an arrangement is illustrated in FIG. 4, wherein each element 110 has a main body 140, which is partially contained in cup-type backing or base 142. The base 142 is preferably of high tensile strength material, such as titanium, steel, aluminium. Alternative materials include polymer matrix composites based on glass fibre, carbon, aramid, polyethylene or similar fibres with an extremely high tensile modulus, or alternatively a high strength plastic such as polycarbonate or nylon.

The base 142 is preferably configured to constrain outward movement of the hard material in the event of a ballistic strike. This is of particular advantage if the hard main body 140 is brittle in character, e.g. if made of a ceramic material.

It is preferred if the main body 140 of the element is located on its base 142 in such a way as to protect the hard element from shock waves which may be reflected by the base member 142 in the event of a ballistic strike. This may be achieved by using a rubbery polymer to affix the hard element 140 on the base 142, thereby localizing shock waves from any impact to the hard element 140. Alternatively, the main body 140 may be partially coupled or acoustically matched to the base member 142. This can be achieved by cementing the hard element 140 to the base 142 using a material having an acoustic impedance greater than 10 MRayl, e.g. a soft metal such as brass, or a braise, or an inorganic cement, or a high density metal powder such as tungsten with a polymeric matrix. Alternatively, the base 142 may be moulded or formed around the main body 142 at the time of manufacture. The coefficient of thermal expansion of the base material (e.g. a metal) is preferably higher than the main body material (e.g. a ceramic or metal/ceramic composite), thereby ensuring a shrink fit of the base 142 on the main body 140, promoting good acoustic coupling. These coupling arrangements are useful in dispersing the energy throughout the system and thus delaying the fracture of the hard element 140 and the joint between the elements 110.

The main body 140 preferably has a facing 144, e.g. of polymeric material, which is configured to enable pre-compression of at least an upper region of the hard main body, upon impact from a bullet or the like. It is particularly preferred if the facing 144 acts as an acoustic decoupling layer between a hard cored ballistic strike and the hard main body 140 of the element 110, for preventing or reducing the transmission of sound waves through to the hard element 140.

An armor system incorporating a plurality of such elements 110 in an array may include a continuous facing layer arranged to cover at least one of the elements in the array, as opposed to individual facings 144 for each element.

The facing 144 is further advantageous in that any sporation that is developed after the hard element 140 has started to fail during a ballistic strike is channeled out in the direction of the bullet. This has the effect that a significant proportion of the kinetic energy of the bullet is channeled back in the direction of the bullet, thus mitigating the effect of the impact. The high impedance of the hard material simultaneously produces a shockwave in the bullet core sufficient to fragment it, thus dispersing the kinetic energy of the bullet.

In preferred embodiments the hard elements in the array 100 will be of ceramic or ceramic-composite structure, e.g. from alumina and aluminium oxide and composites thereof. However, other hard materials may be used, such as borides (e.g. titanium diboride), carbides (e.g. boron and silicon carbide), nitrides (e.g. silicon nitride) and metal-matrix composites such as carbides and borides in a metal matrix, or ceramic-matrix composites which are mixtures of hard engineering ceramics. However, for lower level armor threats, softer materials such as glass or silicate ceramics may be used.

Although the above description and statements of invention refer to octagonal armor elements, the armor elements may have an alternative polygonal configuration capable of a tessellation in an array which defines an aperture between the adjacent elements in the array, e.g. a generally regular polygon having in excess of eight sides.

The invention claimed is:

1. A flexible combat armor system including a group of bullet-resistant armor elements arranged in a tessellated array, wherein each armor element in said group includes a hard main body mounted on a base, wherein the base is configured to provide lateral constraint for side regions of the hard main body, and wherein the main body is of ceramic or ceramic-ceramic composite or ceramic-metal composite material, further wherein the main body exhibits one or more of:

a hardness of at least 7.5 GPa ($Hv_{0.5}$ 750 Kg $mm^{-2}$), for providing bullet-resistance, an acoustic impedance of at least 25 MRayl, for providing bullet-resistance;

further wherein each of said elements is movable relative to an adjacent element in the array, and a nested joint is provided between the adjacent elements, such that an armor elements nests with each adjacent element, and the nested joint is configured to permit rolling articulation between said elements, and further wherein the array defines an aperture between the group of armor elements, and a cover element is arranged to cover the aperture and a significant portion of the joint between the adjacent pairs of the tessellated elements when the upper surfaces of the elements are in register with one another, wherein the cover element is movable relative to each of said tessellated armor elements, and has a stem which extends through the aperture between the tessellated armor elements, and a back stop is connected to the stem to limit movement of the cover element relative to the array.

2. The armor system according to claim 1, including a plurality of said groups, each group having its own cover element.

3. The armor system according to claim 2 wherein the back stop includes a backing element, and respective backing elements in the system are configured to overlap with one another so as to form a backing layer suitable for collecting sporation or debris behind the array of armor elements.

4. The armor system according to claim 3 wherein the backing elements comprise a hard fibrous composite armor material.

5. The armor system according to claim 1 wherein the cover element is configured to cover approximately 50 percent of each joint.

6. The armor system according to claim 1 wherein the cover element has a cap which rests in abutment with the upper surfaces of the elements in the array.

7. The armor system according to claim 6 wherein the cap is dome-shaped, for deflecting armor piercing bullets.

8. The armor system according to claim 1 including limit stops between adjacent elements in the array, to restrict the degree of articulation between the adjacent elements.

9. The armor system according to claim 1 wherein the nested joint is defined by a convex formation on one element and a complementary concave formation on the other element.

10. The armor system according to claim 1, wherein said adjacent elements in the array are arranged for articulation relative to one another, and wherein the degree of articulation between the adjacent elements is restricted to prevent or limit the risk of significant gaps from being generated between the adjacent elements.

11. The armor system according to claim 10 wherein a rolling joint is provided between the adjacent elements in the array, consisting of a concave side on one of the elements which is nested with a convex side on the other of said elements, and wherein the concave side incorporates an ear having a recess, and the convex side has a rib or projection configured to be received in the recess of an adjacent element, wherein the recess acts as a limit stop for the projection, so as to limit the degree of rolling at each joint.

12. The armor system according to claim 11 wherein the ear acts as a deflector for deflecting bullet splash, and the recess acts as a trap for collecting bullet splash.

13. The armor element according to claim 12 wherein the ear has a curvature which is complementary to an arc of articulation between the adjacent elements.

14. The armor system according to claim 11 wherein the ear is configured to extend beneath an adjacent element in the array.

15. The armor system according to claim 11 wherein each armor element in the group includes a projection which is configured to be received in the recess of said ear on an adjacent element in the array, wherein the recess and projection cooperate to limit articulation between the two elements.

16. The armor system according to claim 1 wherein at least one of said elements includes a facing over said main body, wherein the facing has an acoustic impedance which is substantially lower than the acoustic impedance of the main body, for providing bullet-resistance.

17. The armor system according to claim 16 wherein the main body has said acoustic decoupling facing configured to permit pre-compression of the main body upon impact from a bullet.

18. The armor system according to claim 1 wherein the elements are octagonal in plan view.

19. Personnel armor to be worn by a user, the personnel armor incorporating a flexible armor system in accordance with claim 1.

* * * * *